United States Patent [19]

Nakanishi et al.

[11] 4,362,041

[45] Dec. 7, 1982

[54] METHOD OF FORMING BEAM BLANK

[75] Inventors: Teruyuki Nakanishi; Toshiyuki Akune; Takashi Kusaba; Takashi Ehiro, all of Okayama, Japan

[73] Assignee: Kawasaki Steel Corporation, Hyogo, Japan

[21] Appl. No.: 183,829

[22] Filed: Sep. 3, 1980

[30] Foreign Application Priority Data

Sep. 11, 1979 [JP] Japan ..... 54-117026

[51] Int. Cl.[3] ..... B21B 1/08

[52] U.S. Cl. ..... 72/221; 72/366

[58] Field of Search ..... 72/221, 225, 366

[56] References Cited

U.S. PATENT DOCUMENTS 244,811 7/1881 Kloman ..... 72/221

4,086,801 5/1978 Nakajima et al. ..... 72/225

FOREIGN PATENT DOCUMENTS 1254106 11/1967 Fed. Rep. of Germany ..... 72/221

*Primary Examiner*—Lowell A. Larson

*Attorney, Agent, or Firm*—Koda and Androlia

[57] ABSTRACT

A method of forming a beam blank, wherein:

said method comprises:

a process in which a plate-shaped slab is reduction-rolled in the widthwise direction by means of working rolls having box calibers each formed at the center thereof with a belly, whereby side spreadings are generated at opposite end portions in the widthwise direction of said slab to provide a blank of being a dog-bone shape in cross-section; and a process in which said blank is rolled by means of working rolls having beam blank calibers to provide a beam blank being of a predetermined shape in cross section; said process, in which the plate-shaped slab is reduction-rolled in the widthwise direction by means of the working rolls having the box calibers each formed at the center thereof with the belly, preferably comprising: a first step in which said plate-shaped slab is reduction-rolled in the widthwise direction by means of box calibers each formed at the center thereof with a belly to provide grooves for positioning in the centers at opposite end faces in the widthwise direction of the plate-shaped slab; a second step in which said plate-shaped slab is further successively reduction-rolled in the widthwise direction by means of respective box calibers successively larger in caliber width than those used in the preceding step and each formed at the center thereof with a belly fit in said groove; and a third step in which said plate-shaped slab is further reduction-rolled in the widthwise direction by means of working rolls with flat bottoms or working rolls having box calibers each formed with a belly low in height, whereby recesses formed by use of said bellies at opposite end faces in the widthwise direction of the slab are lessened in depth and the side spreadings are further facilitated.

3 Claims, 16 Drawing Figures

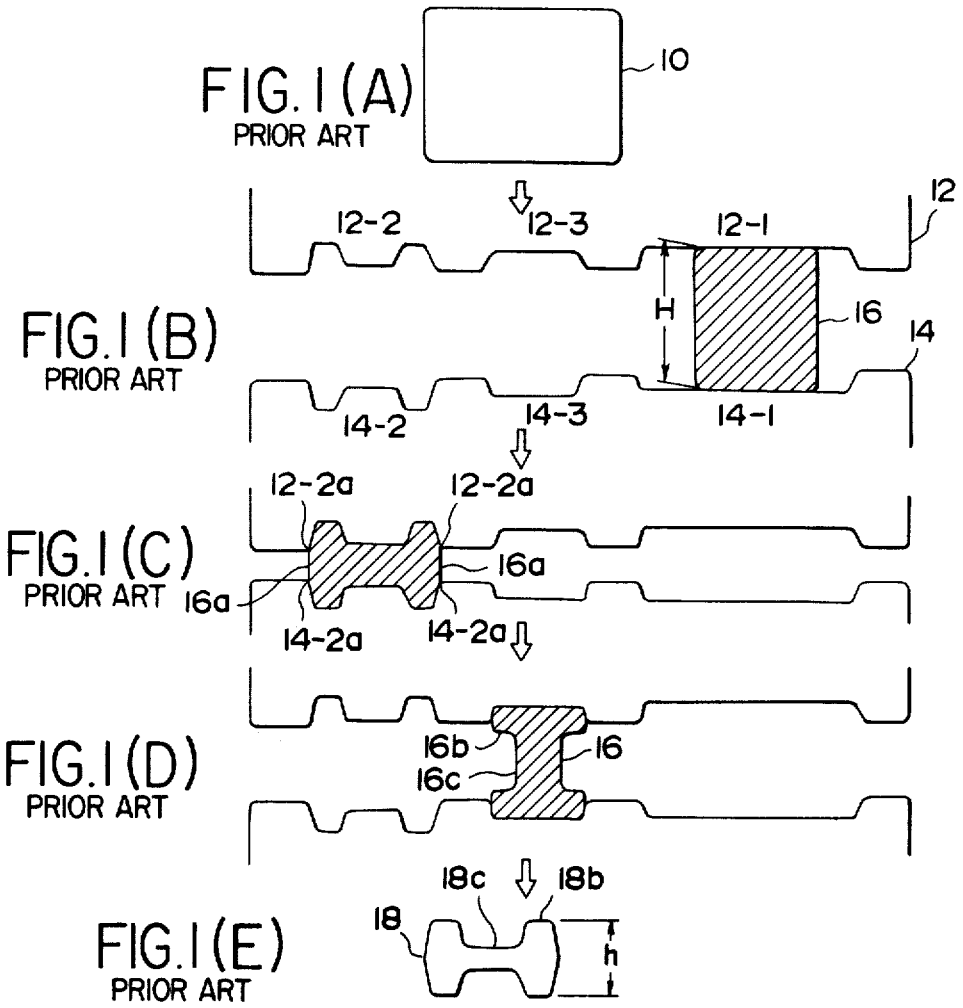
FIG. 2 PRIOR ART
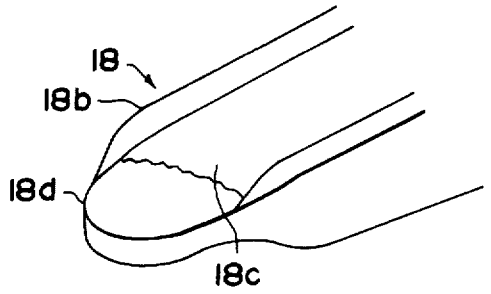

METHOD OF FORMING BEAM BLANK

BACKGROUND OF THE INVENTION

1. Field of the Invention

This invention relates to methods of forming beam blanks, and more particularly to a method of forming a beam blank suitable for use in producing by rolling a beam blank used for rolling a shape steel having a web and flanges.

2. Description of the Prior Art

Heretofore, a beam blank used for rolling a shape steel having a web and flanges such as I-steel or H-steel has been obtained from an ingot after carrying out many passes in blooming mill. Namely, the method of rolling such a beam blank as described above has been effected by a high lift-two high reversible blooming mill with the upper and lower horizontal rolls being provided with a plurality of calibers, and the general procedures of rolling have been as shown in FIG. 1. More specifically, firstly, an ingot 10 being of a rectangular parallelepiped as shown in FIG. 1(A) is rolled to be as flat as a material body 16 having a rectangular cross section introducible to beam blank calibers 12-2, 14-2 by means of bullhead calibers 12-1, 14-1 of working rolls 12, 14, as shown in FIG. 1(B), subsequently, as shown in FIG. 1(C), is caliber-rolled by means of the beam blank calibers 12-2, 14-2 to provide a beam blank 18 having a predetermined shape in cross section as shown in FIG. 1(E). Overfills 16*a* of the material body come out of the side surfaces 12-2*a*, 14-2*a* of the beam blank calibers 12-2, 14-2 during passes under said caliber rolling, and hence, edging rolling is carried out to flatten overfills 16*a* by means of box calibers 12-3, 12-4 at suitable times as shown in FIG. 1(D). Furthermore, during the rolling as described above, flange portions 16*b* of the material body 16 are elongated simultaneously with a web portion 16*c* under the influence of elongation of the web portion 16*c*, and hence, in order to fill the flange portions 12-2, 14-2 of the beam blank calibers with the material body 16 during caliber rolling it is necessary that the height H of the material body 16 in rectangular cross section should be increased with the increase in the width h of the flange of the beam blank. In general, it is necessary that the ratio between the height H of the material body 16 in rectangular cross section and the width h of flange of the beam blank 18 should be more than two.

However, with the conventional method of rolling as described above, there have been disadvantages as shown below.

(1) Increased number of passes is required to obtain the beam blank 18 from the ingot 10. Further, increased number of turning is required for edging rolling by use of the box calibers 12-3, 14-3, thus resulting in lowered rolling efficiency.

(2) A high reduction value for the web portion 18*c* is required as compared with the reduction value for the flange portions 18*b*, with the result that the value of elongation of the web 18*c* becomes larger than that of the flange portions 18*b* to a considerable extent, whereby a web tongue 18*d* shown in FIG. 2 becomes large which should be cut away, thus resulting in lowered yield.

(3) A high reduction value for the web portion 18*c* is required as compared with the reduction value for the flange portions 18*b*, with the result that the roll-away of the surface defects such as below holes, skin holes and side cracks is not enough at the flange portions 18*b*, thus requiring working for removing the surface defects on the finished beam blank 18.

On the other hand, in rolling a plate or the like, there has recently been developed such a method that the process of ingot forming→soaking→blooming is omitted and a plate-shaped slab for a plate is produced by continuous casting. Said production of the slab by the continuous casting can offer various advantages including save of thermal energy, improved internal quality of the material and also improved yield, and hence, to obviate the abovedescribed disadvantages, such a method has been practised as to produce by the continuous casting a beam blank having a section approximating to FIG. 1(E). However, said method requires high installation costs to fulfill the requirements of production of various shapes in cross section of the beam blanks, and hence, with shape steels having an identical cross section with one another in a large amount of production, high profits can be expected, however, with beam blanks having various cross sections each in a small amount of production such as H-steels having large cross section, respectively, only decreased profits are expected.

Then, there has been proposed a method wherein a plate-shaped slab easily produced by continuous casting is rolled by means of roughing mill in a shape steel shop to provide a beam blank 18 as shown in FIG. 1(E).

As shown in an example of Japanese Patent Publication No. 567/70, as a method of rolling a plate-shaped slab to provide an H-steel, there has been proposed a method wherein the reduction-rolling in the widthwise direction of the slab (hereinafter referred to as the "edging rolling") is performed on a plate-shaped slab by means of working rolls each having an edging caliber, whereby side spreadings are generated at opposite end portions of the slab in the widthwise direction, to thereby provide a beam blank being of a dog-bone shape in cross section.

On the other hand, in general, in the case the edging rolling is performed on an elongated material, to prevent the material from falling down or being distorted due to the edging rolling, the elongated material is often rolled by use of box calibers each having a width of the bottom of caliber substantially equal to the width of the material body and a large depth. However, if the width of the caliber is decreased, then the side spreadings of the material body is regulated, and consequently, a necessary width of flange cannot be obtained. According to the aforesaid Japanese Patent Publication No. 567/70, to obtain a necessary width of flange, the edging rolling is performed by use of only the working rolls each having a pair of shallow edging caliber. In this case, however, not only the material being rolled is unstabilized in its posture, but also the material body side-spreaded is forced out of the caliber, thus causing overlaps.

SUMMARY OF THE INVENTION

The present invention has been developed to obviate the abovedescribed disadvantages of the prior art and has as its object the provision of a method of forming a beam blank capable of preventing the material body from falling down, facilitating the side spreading of the material body, moreover, arranging the shapes of the tips of the flanges, and consequently, providing a beam blank satisfactory in quality with a high efficiency and at a high yield.

The present invention comprises the steps of:

edging rolling a plate-shaped slab by means of working rolls each having box calibers each formed at the center thereof with a belly so as to prevent the slab during rolling from being twisted and being distorted and facilitate the side spreadings at opposite end portions of the slab in the widthwise direction; and rolling the blank formed at opposite ends thereof with bulges to be formed into a blank being of a dog-bone shape in cross section by means of working rolls having a beam blank caliber so as to provide a beam blank having a predetermined shape in cross section.

More specifically, the abovedescribed process of carrying out edging rolling of the plate-shaped slab by means of the working rolls having the box calibers each formed at the center thereof with the belly comprises:

a first step of forming a longitudinal groove for positioning at the center of opposite end faces of the slab in the widthwise direction by means of the box calibers formed at the centers thereof with a belly;

a second step of guiding the slab to the center of the caliber by fitting the bellies of the box calibers into the grooves formed in the slab, performing a light edging rolling of the slab and generating the side spreadings in the opposite end portions of the slab in the widthwise direction, while the slab during rolling is prevented from being twisted distorted by preventing the end faces of the slab in the widthwise direction from moving in the direction of the roll axes during rolling owing to the bellies which have bitten into the material body; and a third step of making shallower or eliminating the grooves formed during the preceding step on the end faces of the slab in the widthwise direction.

In the first step of forming the grooves exactly in the centers of the end faces of the shorter sides of the slab, in order to prevent the twist or distortion, the width of the box caliber should be made close in dimension to the thickness of the slab to prevent the end faces of the slab in the widthwise direction from moving in the direction of the roll axes. However, since the opposite end portions of the slab in the widthwise direction have the side spreadings during forming the grooves, the width of the caliber may be made slightly larger in dimension than the thickness of the slab. However, if the width of the caliber is made larger than the thickness by 50 mm or more, shifts of the positions of the grooves from the centers of the end faces of the shorter sides become large, whereby the extent of unbalance in the side spreadings in the lateral direction during rolling thereafter becomes large and the stability of the material body in posture during rolling in the succeeding steps becomes worse.

On the other hand, in the second step of carrying out the edging rolling of the slab and generating the side spreadings in the opposite end portions of the slab in the widthwise direction, if the material comes into abutting contact with the side walls of the caliber, then the side spreadings become restrained. Therefore, the width of the caliber should be as large as possible. However, in order to arrange the portions of the beam blank corresponding to the tip portions of the flanges, there is proposed a method wherein the rolling is carried out such that, at a certain stage, the slab is brought into abutting contact with the side walls to arrange the portions corresponding to the tip portions of the flanges of the beam blank to be produced, and thereafter, box calibers each having a still larger width is used for rolling. In this step, the side surfaces of the material body do not become restrained, however, the end faces of the slab are prevented from moving in the direction of the roll axes by the bellies of the caliber which have bitten into the end faces of the slab in the widthwise direction, so that stabilized rolling can be performed. In this step, a plurality of passes are carried out while the gap between the upper and lower rolls is narrowed pass after pass. The less the reduction value per pass is, the shorter the force of reduction-rolling extends toward the center of the slab in the widthwise direction, whereby only the opposite end portions of the slab in the widthwise direction are deformed, thereby increasing the values of side spreadings. Additionally, there is also such an advantage that the values of side spreadings at the opposite end portions of the slab in the widthwise direction by the edging rolling by use of box calibers each having the bellies are larger than those of the box calibers having no bellies at all, under the reduction values equal to each other.

In the abovedescribed step, grooves are formed in the centers of the end faces of the slab in the widthwise direction pass after pass. These grooves correspond to the opening of the roll gap of the beam blank caliber in the step of rolling by use of the working rolls having the beam blank calibers. In consequence, to prevent the overfills into the roll gap during rolling by use of the working rolls having the beam blank calibers, the presence of these grooves is useful. However, if the depth of the grooves is too large, there may occur overlaps during rolling by use of the working rolls having the beam blank caliber. Therefore, in the succeeding step, the edging rolling is carried out on the slab by means of rolls each having a flat bottom or rolls having the box calibers each formed therein with a low belly, to thereby lessen the depth of the grooves.

In the abovedescribed step of rolling the plate-shaped slab into a dog-bone shaped blank, the slab is disposed in the upright direction and never turned, so that the rolling efficiency can be very high. However, the longer sides of the slab are never reduction-rolled, with the result that there are such possibilities that the bulges thus formed are different in shape and the defects on the surface of the slab from the stage of a raw material remain as they are. Consequently, in the step of rolling by means of the working rolls having the beam blank calibers, the rolling in the direction of the thickness of the slab is carried out to provide a predetermined beam blank.

BRIEF DESCRIPTION OF THE DRAWINGS

The abovementioned features and object of the present invention will become more apparent by reference to the following description taken in conjunction with the accompanying drawings, wherein like reference numerals denote like elements, and in which:

FIG. 1 is a flow sheet showing the procedures of rolling the beam blank produced according to the conventional method;

FIG. 2 is a perspective view showing a tongue-shaped crop at the forward and rear end of the beam blank produced according to the conventional method;

DETAILED DESCRIPTION OF THE INVENTION

Figure 3A:
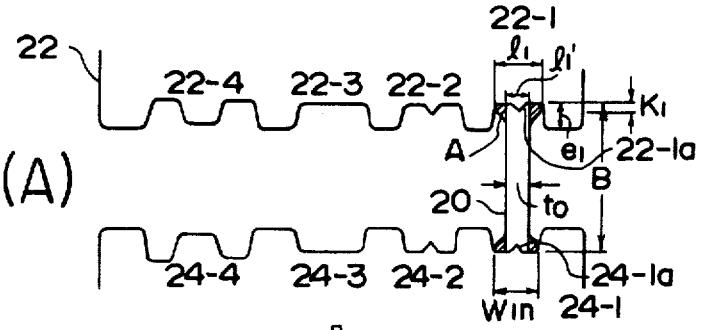
FIG. 3 is a flow sheet showing the precedures of rolling in an embodiment of the method of forming the beam blank according to the present invention.
Figure 3B:
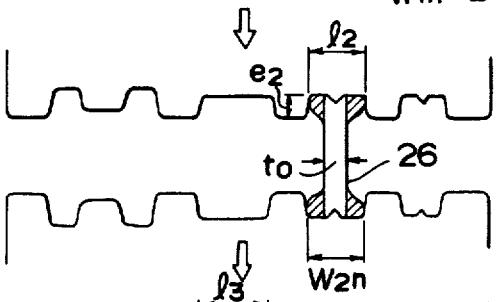

Detailed description will hereunder be given of an example of the method of forming the beam blank according to the present invention with reference to the drawings. FIG. 3 shows the procedures of rolling according to the present invention, wherein, for carrying out the edging rolling on the slab a plurality of box calibers are used, instead of the bullhead calibers of the prior art.

In the rolling of the beam blank according to the present invention, a plate-shaped slab produced by the continuous casting is cut to a predetermined length, charged into a soaking pit or a reheating furnace to be reheated to a predetermined temperature, and thereafter, rolled by use of rolls with calibers as shown in FIG. 3. Such a slab having any suitable width in accordance with the size of the beam blank to be produced may be used. FIG. 3(A) shows the condition where a slab 20 having a thickness $t_0$ extracted from the soaking pit or the reheating furnace is subjected to the edging rolling by use of box calibers 22-1, 24-1 formed on working rolls 22, 24. Said box calibers 22-1, 24-1 are formed at the centers thereof with bellies 22-1*a*, 24-1*a*, respectively, so as to prevent the slab 20 from being twisted or distorted during edging rolling and stabilize the introduction of the slab 20 into the calibers. During the first edging rolling, centering grooves for positioning are formed on the opposite end portions of the slab 20 in the widthwise direction by use of said bellies 22-1*a*, 24-1*a*. Furthermore, the width $l_1$ of the bottom of the box calibers 22-1, 24-1, which is broadened within a range of not exceeding 50 mm over the thickness $t_0$ of the slab, is effective for stabilized groove forming rolling by use of bellies 22-1*a*, 24-1*a* at the initial stage of the edging rolling where the ratio B/Wnn between the width B of the slab and the maximum width Wnn (at the first pass, $Wnn = W_{11} = t_0$) of the flange of the dog-bone shaped blank successively formed is large, thus enabling to prevent the twist and distortion from occurring. The shape and dimensions of said bellies 22-1*a*, 24-1*a* are designed within a range that the introduction of the slab 20 during edging rolling is stabilized and should not be limited to particular values. However, it is suitable that the width $l_1'$ of the bellies is $\frac{1}{2}$ to $\frac{1}{3}$ of the width $l_1$ of the box caliber, and it is preferable that the maximum height $k_1$ of bellies is within the range of $\frac{1}{2}\ l_1'$ to $\frac{1}{3}\ l_1'$. In the drawing, hatched portions A show portions where the side spreading is generated in the slab by the edging rolling, and, a plurality of passes are performed by use of the initial box calibers 22-1, 24-1 until the width $W_1n$ of the flange in the dog-bone shaped blank in cross section formed by the side spreadings become substantially equal to the width $l_1$ of the calibers. Subsequently, as shown in FIG. 3(B), a plurality of passes are carried out by use of second box calibers 22-2, 24-2 until the width $W_2n$ of the flange in the dog-bone shaped blank becomes substantially equal to the width $l_2$ of said second box calibers 22-2, 24-2.

The selection of numbers of the box calibers from 22-2, 24-2 to 22-(n−1), 24-(n−1) may be made within the limit receivable by the length of the rolls used in accordance with the width, thickness of the slab used and the height of web, the width of flange of the beam blank. The selection of the width of the caliber from $l_2$ to $l_{n-1}$ may be preferably made to be about 50 to 150 mm larger than the maximum width $W_{21} \sim W(n-1)_1$ of the dog-bone shaped blank 26 to enter a first pass in said caliber, thus enabling to effectively prevent the twist during edging rolling. Needless to say, as the calibers proceed from 22-2 toward 22-(n−1), a ratio B/W between the height B of the dog-bone shaped blank and the width W of the flange of the dog-bone shaped blank becomes smaller, whereby, twists tend to rarely take place, so that a maximum difference $ln\text{-}Wn_1$ between the width of the caliber and the width of the flange of the blank entering a first pass in said caliber can be increased accordingly.

Furthermore, the box calibers from 22-2, 24-2 to 22-(n−1), 24-(n−1) may be provided with bellies, if necessary, as the first box calibers 22-1, 24-1 are. This selection is decided so as to secure stability of the blank in said caliber during edging rolling, taking into consideration the dimensions of the slab used, desired dimensions of the beam blank to be produced and desired rolling efficiency.

Figure 3C:
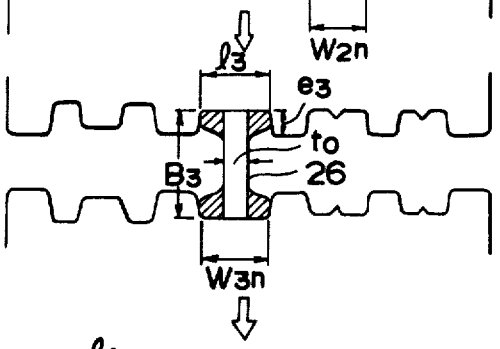

FIG. 3(C) shows the conditions of rolling by use of the final box calibers 22-n, 24-n (in FIG. 3, 22-3, 24-3) where the edging rolling is performed on the slab. Here again, the edging rolling is repeated until the maximum width $W_3n$ of the flange of the dog-bone shaped blank becomes substantially equal to the width $l_3$ of the caliber. The final calibers 22-n, 24-n for performing the edging rolling which have no bellies are effective for enlarging the width of the flanges of the dog-bone shaped blank so as to be farther side-spreaded. However, in the case the overfills 26*a* at the outer surfaces of the flanges as shown in FIG. 3(D) pose problems in the further caliber rolling, the provision of bellies will eliminate the necessity of performing the edging rolling for removing the overfills produced during beam blank caliber rolling.

Figure 3D:
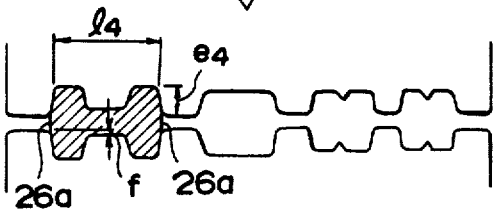

The plate-shaped slab being of a rectangular shape in cross section is subjected to the repeated edging rolling by means of the working rolls 22, 24 having the abovedescribed box calibers until said slab has a height $B_3$ ($B_3 \leqq l_4$) of the dog-bone shaped blank introducible into a width $l_4$ of the beam blanks calibers 22-4, 24-4 as shown in FIG. 3(D) so as to be formed into a dog-bone shaped blank 26.

FIG. 3(D) shows the conditions of forming the dog-bone shaped blank 26 into a desired beam blank by use of the beam blank calibers 22-4, 24-4.

As an example of the rolling method according to the present invention as described above, a specific example will hereunder be shown, in which a plate-shaped slab having a slab width B of 1500 mm and a slab thickness $t_0$ of 310 mm is rolled to provide a beam blank having a web height of 915 mm, flange width of 440 mm and web thickness of 140 mm for rolling an H-steel having a product height of 700 mm and a flange width of 300 mm. Table 1 shown below indicates the data on the dimensions of the group of calibers used, and Table 2 shown below indicates the pass schedules, respectively.

TABLE 1

| Caliber No. | Caliber Width mm ln | Caliber Depth mm ln | Caliber Depth mm f | Belly Width mm ln | Belly Depth mm Kn |
|---|---|---|---|---|---|
| 1 | 360 | 150 | — | 140 | 50 |
| 2 | 450 | 150 | — | 200 | 70 |
| 3 | 570 | 100 | — | 0 | 0 |
| 4 | 915 | 170 | 20 | — | — |

TABLE 2

| Pass No. | Caliber No. | Reduction Value (mm) | Reduction Ratio (%) | Pass No. | Caliber No. | Reduction Value (mm) | Reduction Ratio (%) |
|---|---|---|---|---|---|---|---|
| 1 | X 1 | 20 | 1.33 | 15 | ↓ | 30 | 2.78 |
| 2 | ↓ | 20 | 1.35 | 16 | 3 | 30 | 2.86 |
| 3 | ↓ | 30 | 2.06 | 17 | ↓ | 40 | 3.92 |
| 4 | ↓ | 30 | 2.10 | 18 | ↓ | 40 | 4.08 |
| 5 | 2 | 30 | 2.14 | 19 | X ↓ | 40 | 4.26 |
| 6 | ↓ | 30 | 2.19 | 20 | 4 | 30 | 9.68 |
| 7 | ↓ | 30 | 2.24 | 21 | 4 | 30 | 10.71 |
| 8 | ↓ | 30 | 2.29 | 22 | X 4 | 30 | 12.00 |
| 9 | ↓ | 40 | 3.13 | 23 | X 3 | — | |
| 10 | ↓ | 40 | 3.23 | 24 | 4 | 30 | 13.64 |
| 11 | 3 | 30 | 2.50 | 25 | 4 | 25 | 13.16 |
| 12 | ↓ | 30 | 2.56 | 26 | 4 | 15 | 9.09 |
| 13 | ↓ | 30 | 2.63 | 27 | 4 | 10 | 6.67 |
| 14 | ↓ | 30 | 2.70 | | | | |

In Table 2, Mark X represents the turning.

Figure 4:
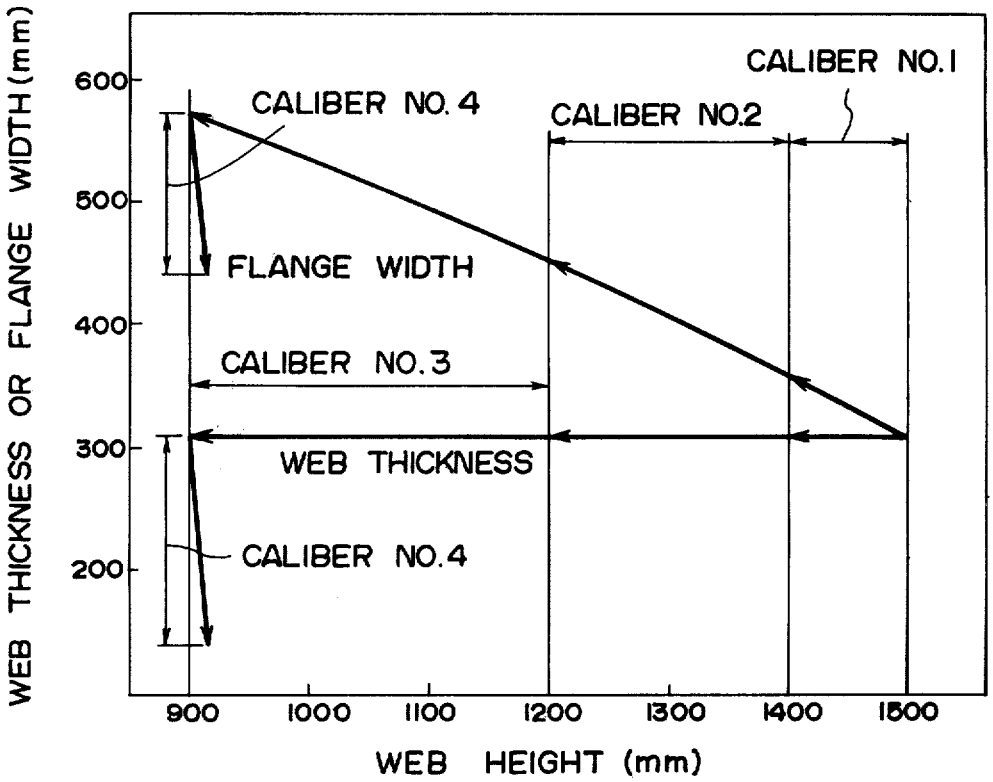
FIG. 4 is a graphic chart showing the relationship between the height and thickness of the web and the width of the flange in the example of the above-described embodiment.
Figure 5:
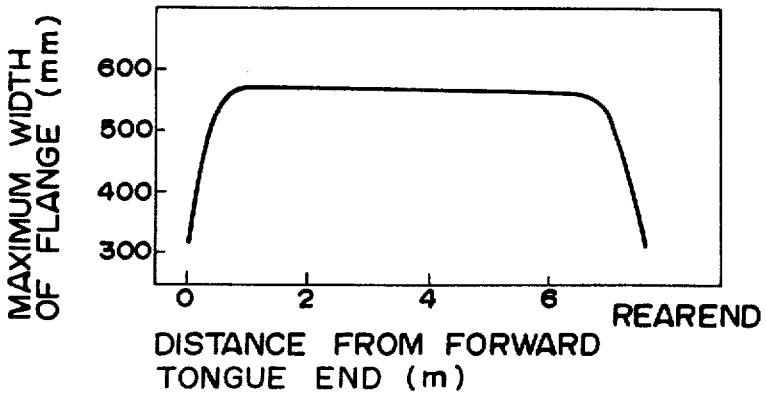
FIG. 5 is a graphic chart showing the distribution in the longitudinal rolling direction of the maximum width of the flange of the dog-bone shaped blank in said example.
Figure 6:
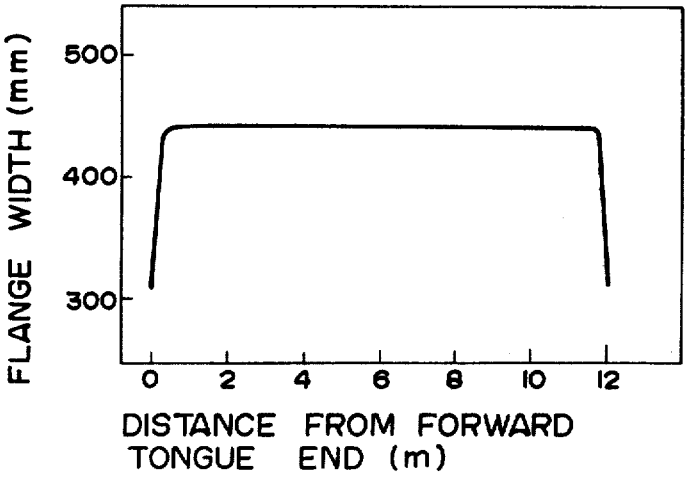
FIG. 6 is a graphic chart showing the distribution in the longitudinal rolling direction of the width of the flange of the beam blank in said example.
Figure 7:
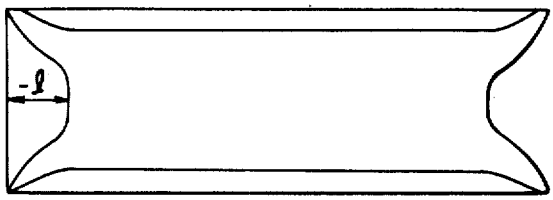
FIG. 7(A) is a schematic side view of the dog-bone shaped blank in said example.
FIG. 7(B) is a schematic side view of the beam blank in said example.
Figure 7:
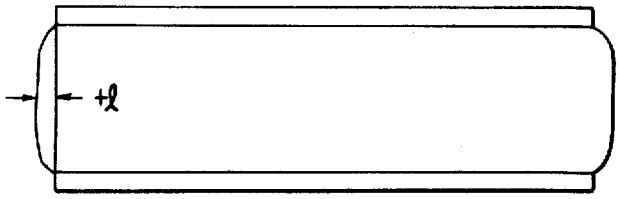
Figure 8:
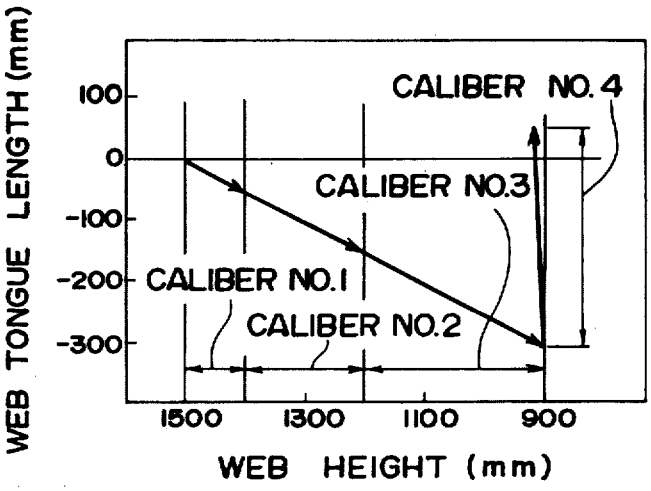
FIG. 8 is a graphic chart showing the condition of change in the length of the web tongue during rolling from the slab to the beam blank in said example.

FIG. 4 shows the progress of the side spreading (in the flange width) and the change in the web thickness against the reduction-rolling of the slab width (the change in the web height) during rolling by use of the respective calibers in this example. From the drawing, it is apparent that very slight reduction-rollings such as 1.3 to 4.3% result in very large side spreadings. FIG. 5 shows the distribution in the longitudinal direction of the maximum width of the flange of the dog-bone shaped blank upon completion of rolling by use of the box calibers 22-3, 24-3. As apparent from the drawing, the side spreadings are small in value within the ranges of 700 mm from the forward and rear ends of rolling, whereby the width of the flanges are decreased. FIG. 6 shows the distribution in the longitudinal direction of the width of the flange of the beam blank, into which said dog-bone shaped blank is finish-rolled by use of the beam blank calibers 22-4, 24-4. As apparent from the drawing, the portions being narrow in width of the flanges as shown in FIG. 5 become considerably shortened, thereby enabling to obtain a satisfactory shape. Furthermore, in the dog-bone shaped blank, the web is as shown in FIG. 7(A), whereas, in the beam blank, the web is as shown in FIG. 7(B), thus enabling to obtain a satisfactory shape. This is because, as apparent from the relationship between the web height and the web tongue length l as shown in FIG. 8, in the case of the box calibers only the reduction-rolling is performed on the flanges and in the case of the beam blank calibers, the reduction-rolling performed on the web of the dog-bone shaped blank is increased, such improvements can be attained at the forward and rear tongue ends of the width of the flanges as shown in FIG. 6 that, when the web is reduction-rolled by means of the beam blank calibers, the forward and rear tongue end portions of the slab being freely deformed tend to fill up the flanges of the beam blank calibers.

In this embodiment, as a plate-shaped slab being of a flat and rectangular shape in cross section, a continuously cast slab excellent in surface properties and having fewer surface defects such as blow holes, skin holes or transverse cracks than the ingot produced by the ingot forming method is used, the surface flaws caused to the surface of the beam blank are reduced in number, and the working process for removing the surface flaws at the stage of the beam blank may be saved.

More specifically, according to the conventional method, in the case the slabs are rolled into the products of the beam blanks without removing the surface flaws, the rejection rate due to the surface flaws on H-steels having a height of 700 mm and a flange width of 300 mm is 0.8% and the rate of required removal of the surface flaws is 26.3%. Whereas, according to this embodiment, the rejection rate is 0.05% due to the surface flaws and the rate of required removal of the surface flaws is 4.3%. As a result, considerable decrease in the both rates has been ascertained. By this, it has become possible to adopt a so-called hot charge or direct rolling, in which a hot slab is transferred to the product rolling process as it is, thus highly contributing to save of thermal energy. However, the plate-shaped slab having a flat and rectangular shape in cross section used in the present invention is not limited to the continuously cast slab. Needless to say, a plate-shaped slab formed by the blooming method well known from an ingot produced by the ingot forming method is usable.

Furthermore, in this embodiment, a reduction-rolling process, in which a plate-shaped slab having a flat and rectangular shape in cross section is formed into a dog-bone shaped blank, is carried out in such a manner that the slab is successively introduced from a caliber having a smaller width to a caliber having a larger width by the working rolls having the box calibers different in caliber width and the reduction-rollings in the widthwise direction of the slab are repeated, so that the twist and distortion during edging rolling can be reliably prevented. In addition, it is also possible to carry out said reduction-rolling process by use of the box calibers of one and the same type in dependence upon the conditions of rolling or dog-bone shapes.

According to the experiments conducted by the present inventors, the scale loss was 2.0% and the crop rate was 6.0% in the example of the prior art, whereas, in the forming method according to the present invention, the scale loss is decreased to 1.5% and the crop rate is reduced to 0.7%. The yield was 92.0% in the example of the prior art, whereas the yield is 97.8% in the forming method according to the present invention, thus accomplishing a considerable increase in the yield by 5.8%. This is mainly because crop portions have been reduced to a considerable extent as shown in FIGS. 7 and 8.

Furthermore, as for the rolling efficiency, in contrast with the prior art, in the example of the present invention as shown in Table 2, the number of passes and the number of turns can be reduced to a considerable extent, thus enabling to increase the blooming efficiency by about 45%.

From the foregoing description, it should be apparent to one skilled in the art that the abovedescribed embodiment is but one of many possible specific embodiments which can represent the applications of the principles of the present invention. Numerous and varied other arrangements can be readily devised by those skilled in the art without departing from the spirit and scope of the invention.

What is claimed is:

1. A method of forming a beam blank having a web and flanges by means of horizontal working rolls provided with calibers for use to produce in subsequent rolling mills a final product of shaped steel, said method comprising the ordered steps of:

reduction-rolling a plate-shaped slab in the widthwise direction at first box calibers each formed at a center thereof with a belly, said first box calibers having a width greater than the thickness of the slab so that side spreadings are generated at opposite ends in the widthwise direction of the slab to make a dog-bone shaped blank, said belly having a tip so sharpened as to form a centering groove for positioning on the opposite end portions of the slab in the widthwise direction;

reduction rolling the dog-bone shaped blank in the widthwise direction at second box calibers each formed at a center thereof with a belly meeting with said groove, said second box calibers having a width greater than a maximum width of the dog-bone blank to enter a first pass at the second box calibers so that the side spreadings are further generated;

further reduction rolling the dog-bone shaped blank in the widthwise direction at final box calibers each having a flat bottom or a bottom formed at the center thereof with a belly low in height, said final box calibers having a width greater than the maximum width of the dog-bone shaped blank to enter a first pass at the final box calibers so that the side spreadings are further progressed; and rolling the dog-bone shaped blank at beam blank calibers in a direction to depress the opposite sides thereof for forming the web portion and the flange portions into their shapes thereby to provide a beam blank being of a predetermined shape in cross section.

2. A method of forming a beam blank as set forth in claim 1, wherein each belly in the first and second box calibers has a width of one half to one third of the box calibers and a maximum bulging height of one-half to one-third the belly width.

3. A method of forming a beam blank as set forth in claim 1 or 2, wherein the width of the first box calibers is greater than a thickness of the plate-shaped slab by an amount of 50 mm or less, and the width of the second and final box calibers is 50 to 150 mm greater than the maximum width of the dog-bone shaped blank to enter the respective calibers.

* * * * *